US006026596A

United States Patent [19]

Seidel

[11] Patent Number: 6,026,596

[45] Date of Patent: Feb. 22, 2000

[54] SKI BOOT WITH A TWO-PART OUTER SHELL

[76] Inventor: Sigurd Seidel, Franzensgasse 26/36 A-1050, Wien, Austria

[21] Appl. No.: 08/293,681

[22] Filed: Aug. 19, 1994

[51] Int. Cl.[7] ..... A43B 5/04

[52] U.S. Cl. ..... 36/117.4; 36/117.3; 36/117.9; 36/118.2; 36/10

[58] Field of Search ..... 36/117, 119, 120, 36/121, 50.5, 10, 55, 117.1–117.9, 118.1–118.9, 119.1

[56] References Cited

U.S. PATENT DOCUMENTS

| | | | |
|---|---|---|---|
| 4,565,017 | 1/1986 | Ottieri | 36/117 |
| 4,823,485 | 4/1989 | Kemmer | 36/119 |
| 4,920,666 | 5/1990 | Marega | 36/10 X |
| 4,937,953 | 7/1990 | Walkhoff | 36/117 X |
| 5,001,851 | 3/1991 | Baggio et al. | 36/119 |
| 5,142,798 | 9/1992 | Kaufman et al. | 36/117 |
| 5,152,084 | 10/1992 | Bonnaventure | 36/50.5 X |

*Primary Examiner*—Ted Kavanaugh
*Attorney, Agent, or Firm*—Herbert L. Lerner; Laurence A. Greenberg; Werner H. Stemer

[57] ABSTRACT

A ski boot includes a two-part outer shell with a foot part and a shank part pivotally connected with the foot part. An inner boot is received in the two-part outer shell. The shank part pivots between a relaxed position and a latching downhill position, in which it may be locked by a latching mechanism. The latching mechanism includes an actuating device for releasing the shank part from the locked latching downhill position. A first tensioning system disposed in the outer shell retains the inner boot in the outer shell and it is released when the shank part is in the relaxed position. A second tensioning system disposed in the outer shell holds the inner boot downward against the sole of the outer shell when the shank part is locked in the latching downhill position. A rear flap is pivotally connected at the heel of the foot part, such that the inner boot can be inserted into the outer shell when the rear flap is opened.

21 Claims, 9 Drawing Sheets

SKI BOOT WITH A TWO-PART OUTER SHELL

BACKGROUND OF THE INVENTION

FIELD OF THE INVENTION

The invention relates to a ski boot having a two-part outer shell comprising a foot part and a shank part, the foot part being joined to the shank part via a joint, and an inner boot.

Known ski boots of this type are widely used in modern skiing, both by recreational skiers and professional skiers. For the sake of better skiing posture, the shank of such ski boots is constructed in such a way that it is positioned at a certain angle a relative to the vertical (as defined when the sole of the boot is oriented horizontal). As a result, during skiing the skier more easily assumes the desired leaning position that allows him to execute the turns especially exactly. However, the result is that in periods before or between skiing runs, for instance when waiting in line at the ski lift, the skier is obligated to wait in a very unnatural, hunched posture. This makes for poor circulation and muscle cramps, which can impair the skier's skills and is accordingly a cause of skiing accidents.

Another reason for poor circulation in the foot muscles is the firm clamping of the foot in the ski boot, which is important for optimal skiing so that a direct transmission of force to the underlying ground occurs when the turns are begun. In intervals between downhill runs, the immobilized feet suffer especially from the clamping and from the cold outside, so that before starting downhill, the skier must often perform warmup exercises, if he wants to protect himself against the danger of a skiing accident. On the other hand, it is very inconvenient and complicated to loosen conventional ski boots, so as to relieve the pressure on the feet, by opening the buckles, for instance. Finally, known ski boots of this kind have the disadvantage that they are completely unsuitable for walking or driving automobiles, for instance, and are best taken off for those purposes, but that is uncommonly time-consuming.

SUMMARY OF THE INVENTION

It is accordingly an object of the invention to provide a ski boot with a two-part outer shell, which overcomes the hereinafore-mentioned disadvantages of the heretofore-known devices of this general type and which not only allows an ideal leg position for downhill skiing but also for normal waiting or standing in the ski boots. Another object of the invention is to enable quick fastening and loosening of the ski boot, so that there will be good circulation in the feet while waiting. Finally, it is also an object to create a ski boot that can be used not only for skiing but also for walking or driving cars and that allows the foot the necessary freedom of motion for those purposes.

With the foregoing and other objects in view there is provided, in accordance with the invention, a ski boot assembly, comprising: a two-part outer shell including a shank part and a foot part pivotally connected with said shank part; and an inner boot to be received in said two-part outer shell; pivot means allowing said shank part to be pivoted relative to said foot part between a relaxed position and a latching downhill position; latching means for locking said shank part in the latching downhill position; said latching means including an actuating device for releasing said shank part from the locked latching downhill position; a first tensioning system disposed in said outer shell for retaining said inner boot in said outer shell, said first tensioning system being released when said shank part is in the relaxed position; and a second tensioning system disposed in said outer shell for holding said inner boot downward against a sole of said outer shell when said shank part is locked in the latching downhill position.

In other words, the shank part of the ski boot can be swiveled from a relaxed position into a latching downhill position and it is lockable in that position. An actuator, or actuating device, is provided for the release of the locking. The inner boot is retained in the outer shell with first tension system, which is released in the relaxed position. The inner boot is held down against the sole of the outer shell, when the downhill position is latched, with a second tension system.

As a result, on the one hand, a desired, for instance slightly leaning downhill position can be assumed during downhill skiing, and on the other an uncramped, for instance upright posture can be assumed while waiting during the pauses between runs. In the relaxed position, the pressure on the feet that otherwise during skiing are fastened and clamped is relieved, so that there are no disruptions to blood circulation.

In accordance with a further feature of the invention the inner boot is insertable into the outer shell by means of a rear flap hinged to the foot part. As a result, the skier can walk around or rest wearing the inner boot only during pauses between runs.

Preferably, also, the first tension system is embodied by a central variable-tension system. Fastening the ski boot is made substantially simpler as a result, because a central knob, for instance, no longer needs to be actuated, which is a very important aspect for easy use of the ski boot at low temperatures.

In accordance with another feature of the invention, the second tension system holds the inner boot down against the sole of the outer shell in the downhill position by pressing the first tension system against the instep part of the inner boot.

As a result, the pressure exerted on the foot is distributed uniformly in accordance with the shape of the skier's instep.

In accordance with an added feature of the invention, the shank part is provided with an extension which protrudes into the foot part and in the foot part rests on stop devices provided for that purpose in the relaxed position, or latches in detent devices provided for that purpose in the downhill position.

In this way, both positions can be achieved in a simple way.

In accordance with an additional feature of the invention, the extension of the shank part is formed by an essentially U-shaped hoop that extends between the outer shell and the inner boot and is joined at its ends to the shank part. The joint is formed by two pivot shafts that penetrate the shell wall of the foot part and each penetrates one side part of the hoop. The relaxed position and the downhill position can be selected by means of a stop and detent position, respectively, of the crossbar of the U-shaped hoop in the interior of the foot part. And the crossbar tenses the second tension system in the downhill position, so that the first tension system is pressed against the instep part of the inner boot.

As a result, the mechanism remains concealed and can be accommodated with a lightweight structure in the ski boot, despite major demands for strength, so that there are no disadvantages in terms of weight.

In accordance with yet an added feature of the invention, the crossbar is held in the relaxed position on a stop device embodied as a stop by a spring, preferably a helical spring, and is lockable in the downhill position via a detent device embodied as a detent flap; and the actuating device is formed by an outrigger with an actuation knob, the outrigger being formed onto the detent flap and passed through the shell wall of the foot part, with which outrigger the crossbar can be released from the downhill position.

The result is especially simple, secure latching into the downhill position and an equally easily achieved release of this downhill position.

In accordance with yet an additional feature of the invention, the detent flap is held in its detent position by a spring, preferably a helical spring.

As a result, a mechanism that needs little space and also has a long expected service life can be created.

In accordance with yet a further feature of the invention, the second tension system is formed of two wire cables passed from the front portion of the foot part toward the rear portion, in each case guided laterally by the first tension system.

By this characteristic, the motion for assuming the downhill position can at the same time be used to tense the tensioning system.

In this context it is provided, in accordance with again an added feature of the invention, that the central variable-tension system is formed essentially of two instep covers displaceable parallel to one another transversely to the longitudinal direction of this system, the covers having eyelets disposed longitudinally on each instep cover, and a lockable tension disk disposed centrally above the instep covers, wherein a tension cable is passed through the eyelets in the manner of shoelaces and fixed on its ends on opposed circumferential regions of the tension disk; and that the wire cables are passed through openings on the two outer long sides of the instep covers.

Because of the central disposition of the tension disk, pulling together the tension jaws of the tension system can be done very uniformly and requires little exertion of force, so that it is comfortable and easy to use.

In accordance with again another feature of the invention, a rotary disk with a hinged wing is disposed on the pivot shaft of the tension disk, which pivot shaft passes through the shell wall of the foot part.

Because the hinged wing can be folded down out of the way, the tension system only slightly disturbs the external visual impression of the ski boot, yet brings about a very good transmission of force from the hand to the tension cable for pulling together the tensions jaws.

In accordance with again a further feature of the invention, the pivot shaft is formed of a cylindrical middle part and on each of its ends has one polygonal, preferably hexagonal, cross-sectional region that is rounded hemispherically on each of its ends; and that one bearing bush of polygonal, preferably hexagonal, cross section corresponding to the pivot shaft is disposed in the center of the rotary disk and in the center of the tension disk, so that the ends of the pivot shaft engage the bearing bushes with play and the transmission of force from the rotary disk to the tension disk is possible in various relative positions of the pivot shaft.

As a result, the instep covers can be adapted uniformly to very different instep shapes.

In accordance with another feature of the invention, the rotary disk is subdivided on its underside into detent segments, which are engaged in succession by a resiliently supported detent pin, extending radially toward the disk, when the tension cable is tensed by rotation of the hinged wing. The pin can be released from the detent position by a releasing device that is accessible from the outside of the ski boot.

In this way, the rotary disk and with it the tension disk are lockable, so that the tension of the tension wire, once established, is not lost. If needed, the pressure of the tension jaws can be released by pressing the actuation device.

In accordance with an added feature of the invention, the releasing device is formed by a halfmoon-shaped release pushbutton formed onto the detent pin and partly encompassing the rotary disk.

The result is a disposition of the release device that is lowered out of the way in the shell wall and is easy to use.

In another feature of the invention it may be provided that a dog with which the inner boot engages a corresponding projection in the rear flap is formed onto the inner boot in the region of the heel.

As a result, even when there is a very heavy strain during skiing, the inner boot cannot slip out of the outer boot, since it is suitably anchored in the ski boot.

In accordance with again another feature of the invention, the inner boot is formed like a slipper sock, and a profile and tread may be embodied on the underside of the inner boot. As a result, the inner boot can be worn even on a slippery or wet surface, and moreover can be put on very quickly.

In accordance with yet an added feature of the invention, the angle $\alpha$ between the relaxed position and the downhill position is substantially 17°.

Hence in the relaxed position, the skier's legs can support his body in a natural way, while during skiing a slightly leaning position is assumed.

In accordance with yet a further feature of the invention, the shank part and the rear flap can be joined by connecting rods, the connecting rods preferably being connectable in the region of the rear flap by a plug-type closure.

As a result, the rear flap is pressed against the rear part of the inner boot so that the skier's lower leg is suitably braced on all sides.

Finally, In accordance with a concomitant feature of the invention, tension elements tense the connecting rods by lever action when the hinged cover disposed on the rear flap is closed.

By means of this characteristic, very good bracing of the lower leg on all sides by the shank part and the rear flap can be created.

Other features which are considered as characteristic for the invention are set forth in the appended claims.

Although the invention is illustrated and described herein as embodied in a ski boot with a two-part outer shell, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
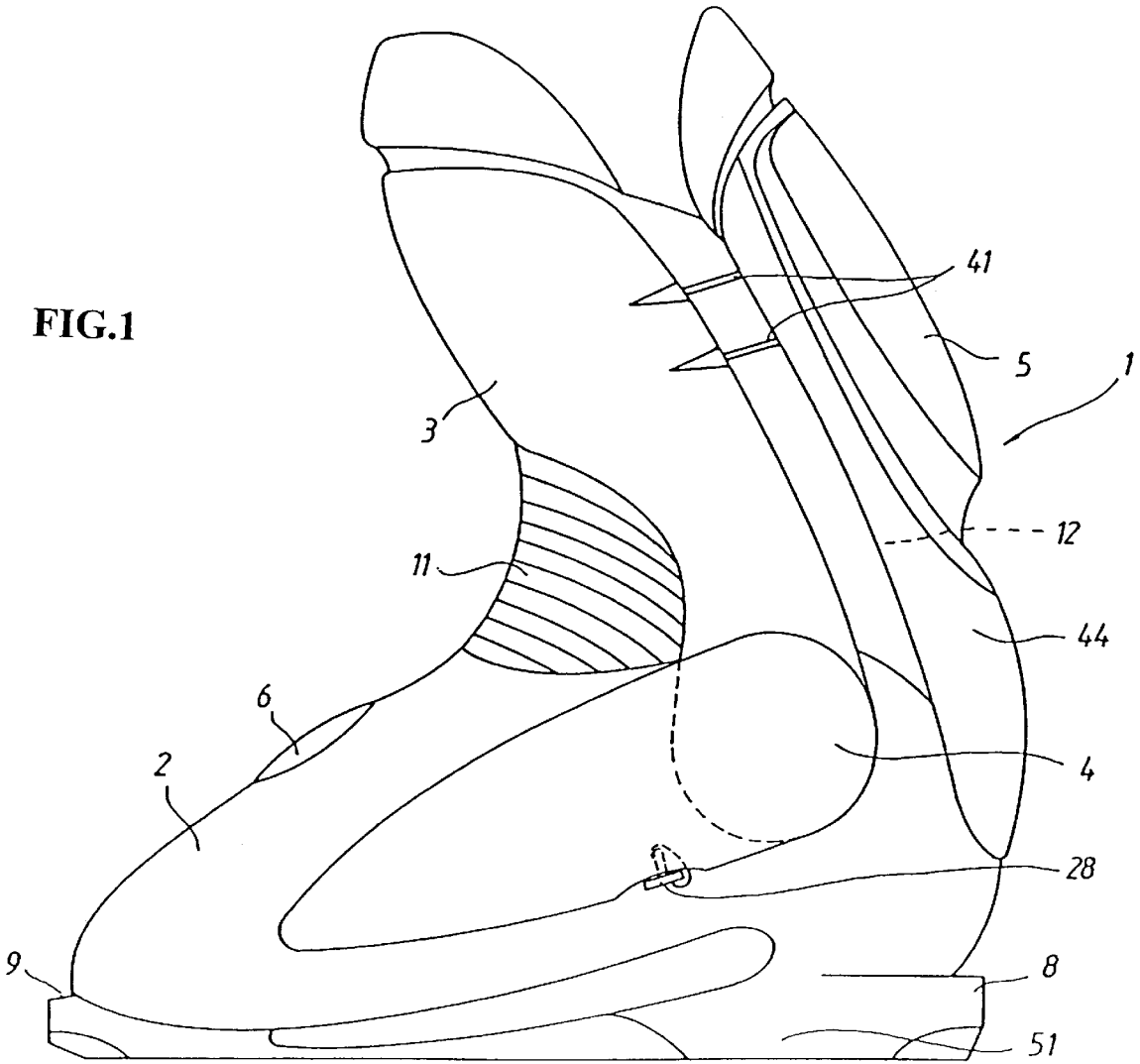
FIG. 1 is a side-elevational view of a ski boot according to the invention without an inner boot.
Figure 2:
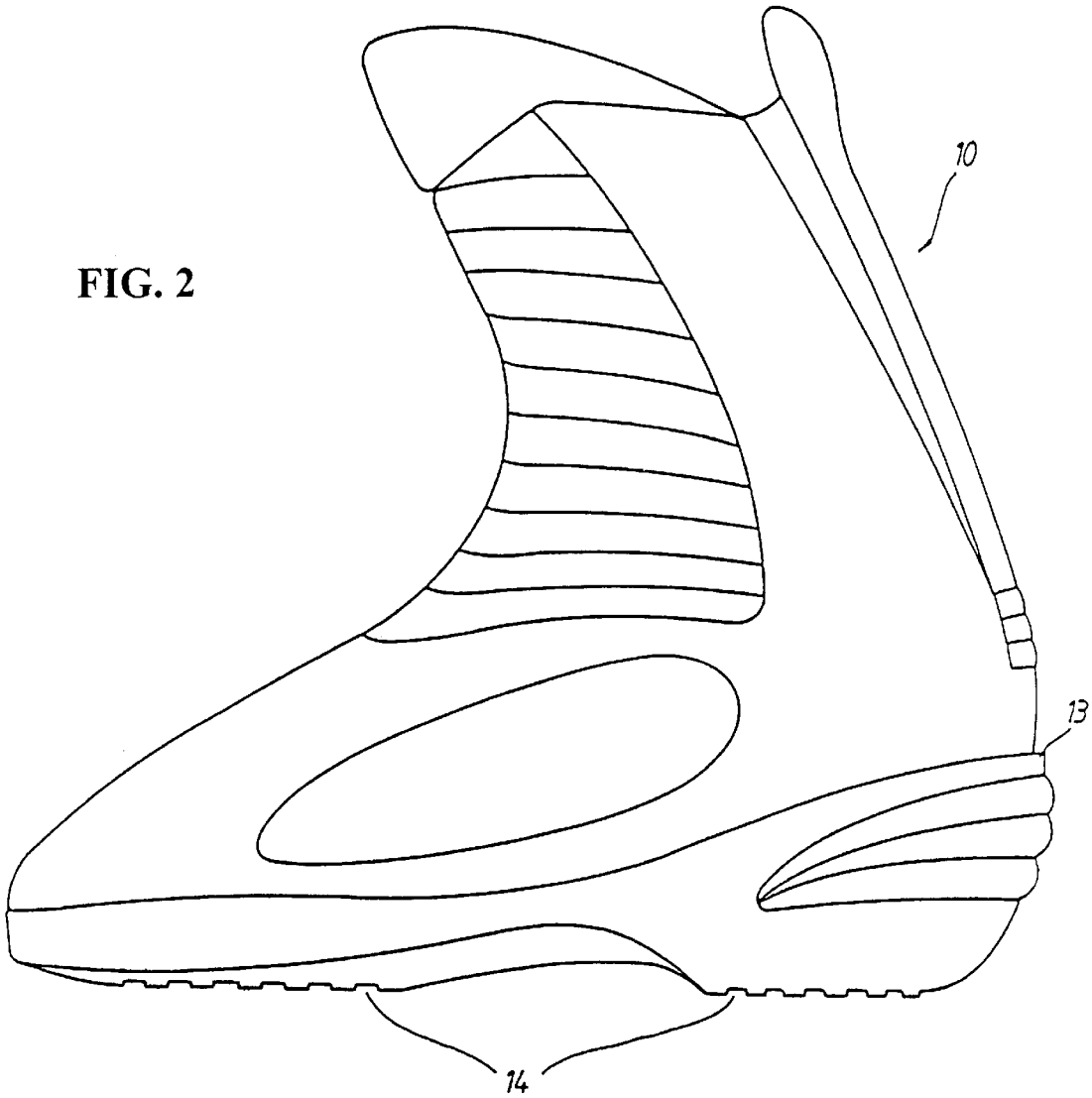
FIG. 2 is a side-elevational view of an inner boot according to the invention.

Referring now to the drawings in detail and first, particularly, to FIGS. 1 and 2 thereof, there is shown a portion of a ski boot 1, which is composed of a two-part outer shell 2, 3 and an inner boot 10 (FIG. 2). Binding ledges or protrusions 8, 9 are formed on a sole 51 of the ski boot 1 in the front and rear regions, respectively. The ledges meet the usual national safety regulations, so that the ski boot 1 can be combined with any current safety binding.

The two-part outer shell includes a foot part 2 and a shank part 3. The foot part 2 is joined to the shank part 3 via a joint 4. An inner boot 10—as shown in FIG. 2—can be inserted into this outer shell, which in its interior receives a mechanism to be described in detail hereinafter. In one variant of the invention, the inner boot 10 is introduced into the ski boot 1 from behind via an entry opening 12 that can be closed with a rear flap 44 disposed on the foot part 2. This makes it easy for the skier to put the ski boot on and take it off while wearing the inner boot 10, so that in intervals between runs the skier can simply leave his skis and boots behind and walk or drive a car, for instance, while wearing the inner boots. A cover lid 5 is also provided in the rear flap, under which tension elements 43, not illustrated in FIG. 1, that are let into the rear flap 4 and that fasten the shank part 3 to the rear flap 44 via connecting rods 41 can be accessed. The shank part 3 of the ski boot 1 is swivelable from a relaxed position into a latching downhill position and can be locked in the latter position. In a variant of the invention, the angle $\alpha$ between the relaxed position and the downhill position is 17°. The relaxed position is a position which the skier assumes during all the intervals between ski runs. According to the invention, the skier is enabled to stand upright in the ski boot. This is especially advantageous when waiting in long lift lines or in short pauses to rest. The downhill position is a position in which the shank of the ski boot is inclined slightly forward, to allow the skier to turn especially accurately by having his legs in a slightly leaning position. To release the downhill position lock, an actuation device 28 is provided, which can be actuated by hand or with a ski pole.

A first tensioning system 30 is provided for retaining the inner boot 10 in the outer shell. The system 30 is released in the relaxed position. The first tensioning system 30 may be embodied in various ways. A single-buckle or multi-buckle system, for instance, or a central variable-tension system may be provided. In the exemplary embodiment of FIG. 1, a central variable-tension system 30 is realized, of which in FIG. 1 only a rotary disk 6 for actuating it can be seen.

A second tensioning system 22 is provided to hold the inner boot 10 down against the sole of the outer shell. The second tensioning system 22 connects the skier's foot, the inner boot 10 and the outer shell 2 and 3. The connection is a force-locking connection and its purpose it to provide an optimal transmission of force to the ski slope. In the downhill position, this system is tensed, so that during downhill skiing the desired pressure can be exerted on the foot, while in pauses to rest the foot can be relieved by changing to the relaxed position. The second tensioning system 22 thus assures a reliable conversion of the motion of the feet to the skis, and this second tensioning system may be embodied in various ways. One possible embodiment is represented by tightenable wire cables 22 in FIG. 3. In the ski boot 1 in the assembled state, part of the inner boot can be seen through the recess 11 in FIG. 1.

In FIG. 2, an embodiment of an inner boot 10 according to the invention is shown; it fits into the two-part outer shell of FIG. 1 and is embodied from both an aesthetic and an orthopedic standpoint. For all the skier's activities for which he does not directly need the skis, such as driving a car or entering ski huts or the like, he then walks around wearing only this inner boot, which in a variant of the invention is equipped with a tread 14 on its underside, to give it a good grip even on slippery terrain, the profile being embodied in the form of a slipper sock. As a result, the inner boot 10 is very easy to put on.

In accordance with another feature of the invention, a protrusion 13 is formed on in the region of the heel of the inner boot 10, and with it the inner boot 10 engages a corresponding projection 47 (FIG. 3) in the ski boot, so that there is an adequate hold of the inner boot even when severe strain is put on it while skiing, and the inner boot cannot slip out of the outer shell 2, 3.

Figure 3:
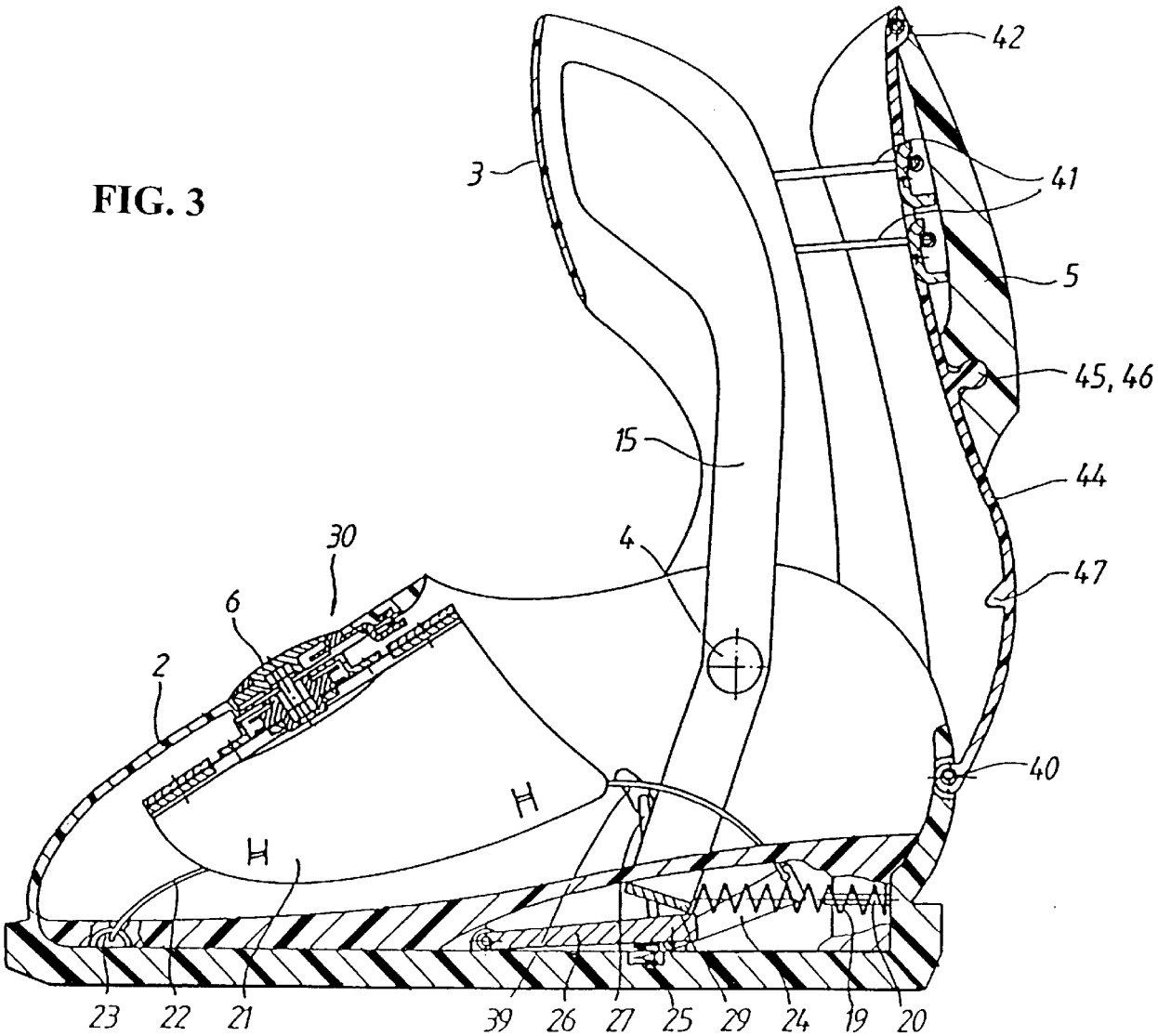
FIG. 3 is a longitudinal section through a ski boot of FIG. 1 in the relaxed position.

FIG. 3 shows a longitudinal section through the two-part outer shell 2, 3 in the relaxed position. The shank part 3, in one embodiment of the invention, is provided with an extension 15 which protrudes into the foot part 2 and in the foot part 2 rests on stop devices or latches into detent devices 26 provided for those purposes. The stop devices which the extension 15 strikes in the relaxed position or additionally strikes for latching purposes in the downhill position may for instance be provided by protrusions formed onto the outer shell in the lateral regions. The extension is embodied by an essentially U-shaped stirrup or hoop 15, which extends between the outer shell and the inner boot 10 and is joined to the shank part 3 on its ends.

Figure 6:
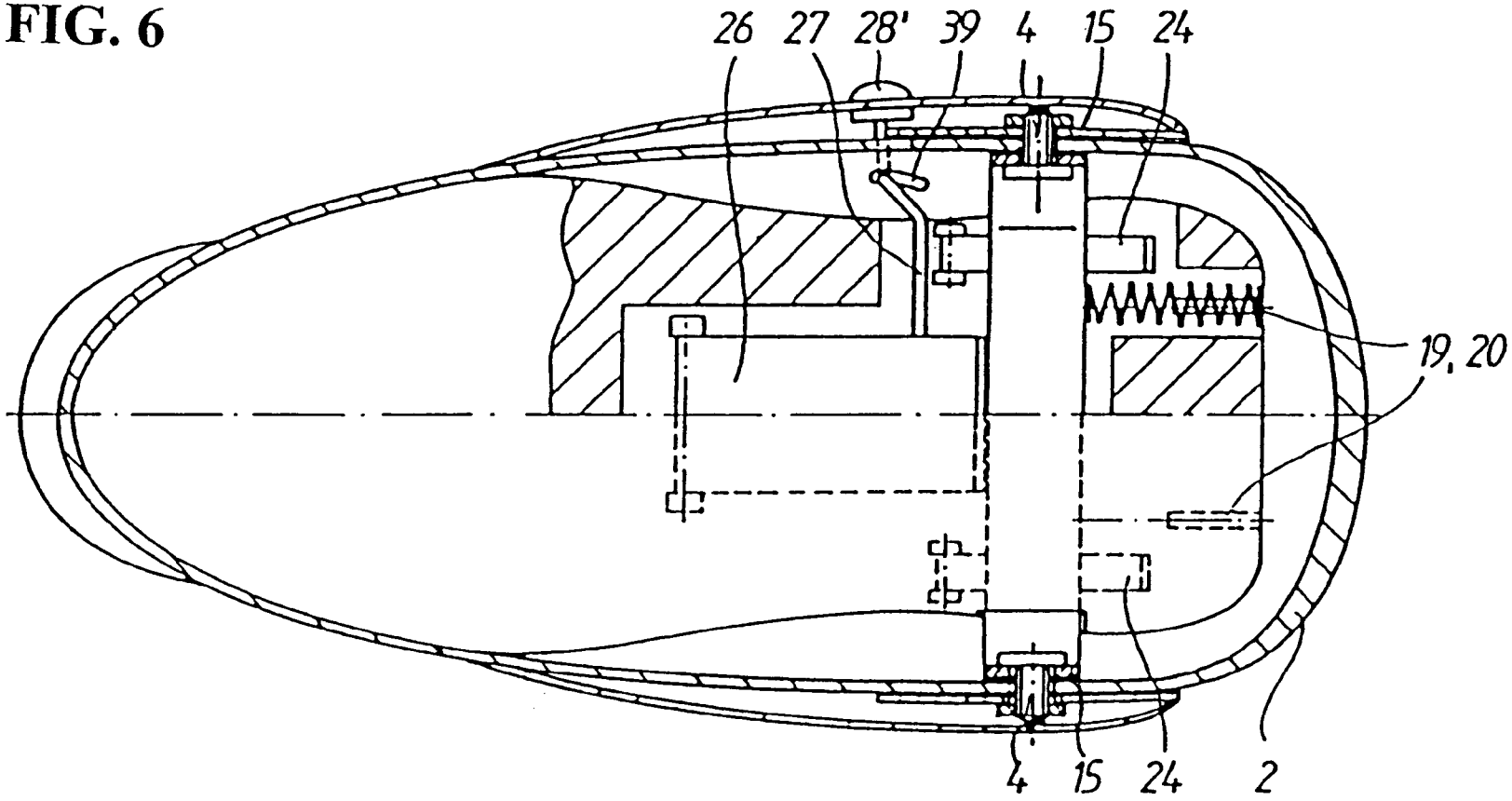
FIG. 6 is a sectional view through the foot part of the ski boot taken along the line VI—VI of FIG. 4 and viewed in the direction of the arrows.

As can be seen from FIG. 6, the joint is formed by two pivot shafts 4, which pass through the shell wall of the foot part 2, and each passes through one side part of the hoop 15; on each of their ends the pivot shafts 4 have an attachment for fixing them in their position. By means of these pivot shafts 4 it is possible to swivel the shank part 3 of the ski boot 1 relative to the foot part 2. Two positions, the relaxed and the downhill position, are defined in this way and can be selected by means of the stop or detent position, as applicable, of the crossbar 29 of the U-shaped hoop 15 in the interior of the foot part 2. Within the scope of the invention, other forms of extensions may also be provided, instead of the hoop 15. For instance, an extension may also be formed integrally onto the shank part 3 and with its end may engage the most various types of stop or detent devices which guarantee the downhill and relaxed positions of the ski boot.

FIG. 3 also shows the central variable-tension system 30 with instep covers 21. It can be actuated via a rotary disk 6 disposed outside the outer shell. The first tensioning system 30 is embodied such that one wire cable 22 is passed through each of the side parts from eyelets 23 in the front portion of the foot part 2 to a pivot lever 24 that is disposed in the rear portion of the foot part 2 and is swivelable about an axis. The wire cable 22 is joined to the lever 24, so that the crossbar 29 does not touch the pivot lever 24 in the relaxed position, and hence the first tensioning system 30 is not tensed on its side portions by the second tensioning system 22 and is thus released. If the shank part 3 and hence the hoop 15 with its crossbar 29 is moved to the downhill position, by being rotated towards the toe of the boot, then the crossbar 29, by its rotary motion about the joint 4, presses the pivot lever 24 down and thus tightens the wire cables 22. Accordingly, the wire cables 22 press the first tensioning system 30 against the instep part of the inner boot 10 (FIG. 4) and thus hold the inner boot 10 down against the sole of the outer shell.

The crossbar 29 of the U-shaped hoop 15 is biased in the relaxed position by a spring, which in FIG. 3 is embodied as a helical spring 19; the helical spring 19 is mounted on an arbor 20 on one side. However, the spring 19 may be embodied by any other spring acting in this way, such as a leaf spring or a tension spring.

The projection 47 that engages the inner boot 10 is also disposed on the rear flap 44.

Figure 4:
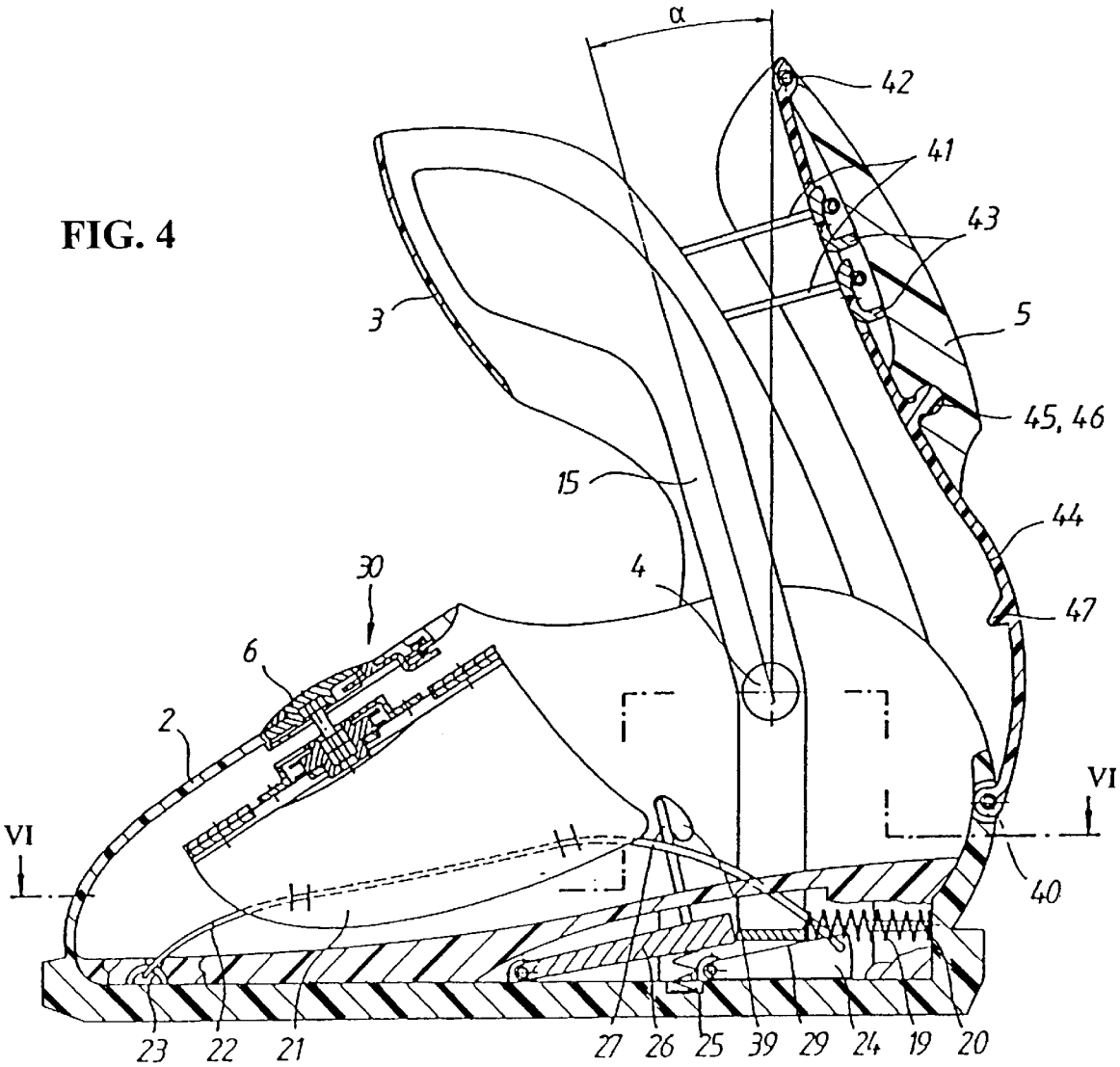
FIG. 4 is a similar view of the ski boot in the downhill position.

In FIG. 4, the ski boot 1 is locked in the downhill position via a detent flap 26, with the shank part 3 of the ski boot 1 inclined from the vertical by an angle $\alpha$, preferably 17°. In one embodiment of the invention, the detent flap 26 is retained in its detent position by a spring, preferably a helical spring 25. To assume the downhill position, when the shank part 3 and with it the cross bar 29 is swiveled, the helical spring 19 must be compressed along its longitudinal axis. This is done in that the cross bar 29 presses against the spring 19. As soon as the preselected swivel angle $\alpha$, in this case 17°, has been traversed, the detent lever 26 that is subject to the bias force of the spring 25 can swivel upward and prevents the hoop 15 from swiveling back into the relaxed position. In the downhill position, a desired damping effect is also provided by the spring 19, so that upon impacts from the outside, such as from bumps and moguls in the terrain, the shank part 3 can swivel somewhat beyond its established position. The spring 25 presses the detent flap 26 upward in such a way that the crossbar 29 latches through it.

An actuation device 28 is connected to the detent flap 26 by means of an outrigger 27 that is formed onto the detent flap 26 and passed through an opening 39 in the shell wall; with this outrigger, the crossbar 29 can be released from the downhill position. To free the hoop 15 from its latched position, the detent lever 26 can be pressed downward via the outrigger 27, overcoming the force of the spring 25; as a result, the spring 19, which is under tension, swivels the crossbar 29 and with it the hoop 15 back into the relaxed position.

When the pivoting motion from the relaxed position to the downhill position is executed, the wire cable 22 (embodied as the second tensioning system) is tightened by the crossbar 29 of the hoop 15, and the instep covers 21 are pulled downward by their outer regions as soon as they contact the instep of the foot. Adapting the instep covers 21 to the shape of the skier's instep is done by means of the first, central variable-tension system 30 (FIGS. 7–11) in the relaxed position.

The cover lid 5 that can be pivoted about a pivot shaft 42 is integrated with the rear flap 44, which is supported rotatably about a pivot shaft 40 on the rear foot part 2. The cover lid 5 has a recess 46, into which a detent protrusion 45 formed onto the rear flap 44 can latch. Located under the cover lid 5 are the tension elements 43, and extending around them are the connecting rods 41, which are joined to the shank part 3 and are connectable in the space underneath the cover lid 5. If the connecting rods 41 are joined by means of a plug-type closure, for instance, and if the cover lid 5 is closed, then the rear flap 44 and the shank part 3 are joined together with a tension exerted by the tension elements 43. In order to put the ski boot on while wearing the inner boot, the connecting rods 41 are disconnected from their plug-type connection and the rear flap 44 can be swiveled rearward, as can be seen from FIG. 5.

Figure 5:
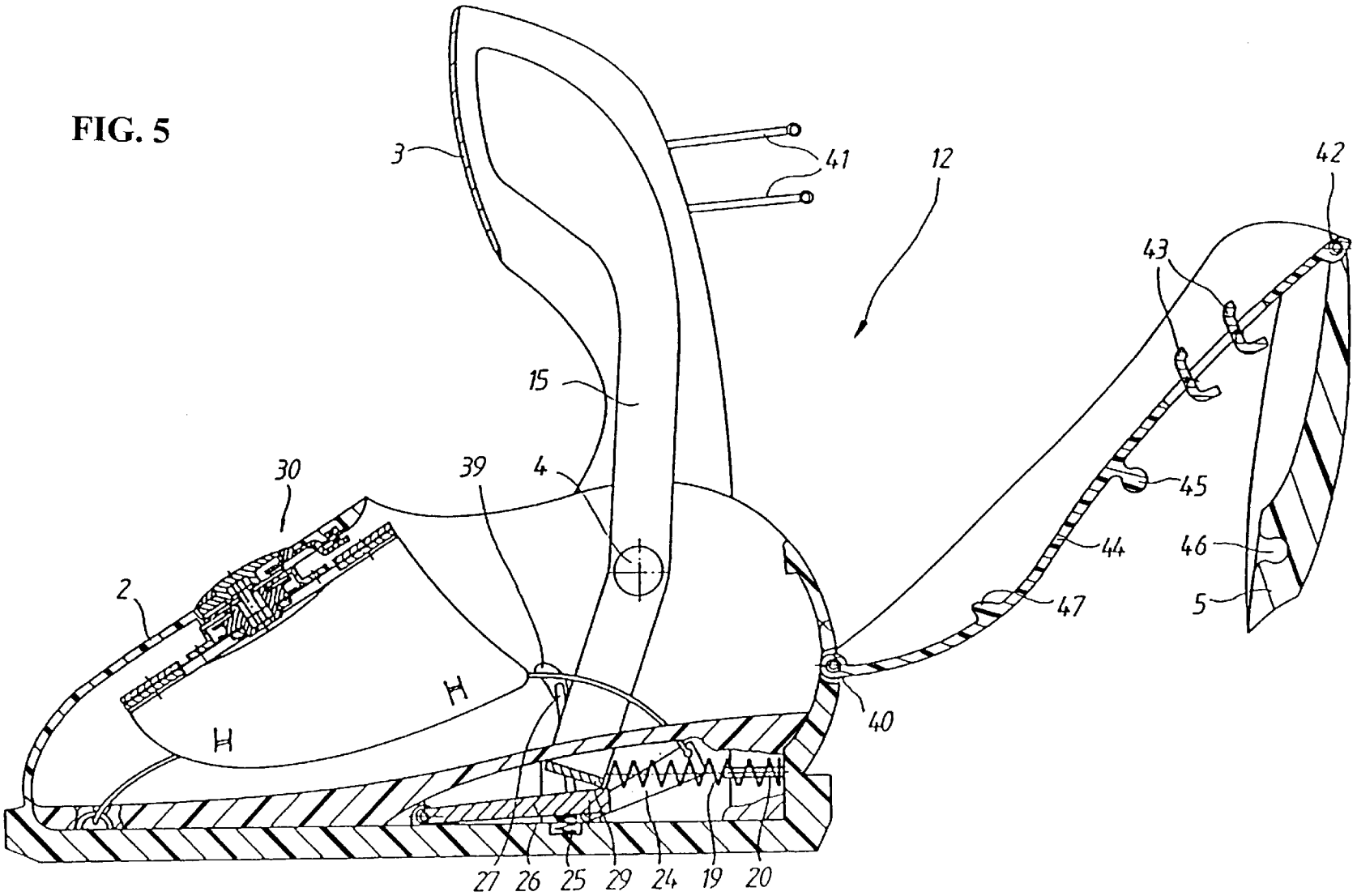
FIG. 5 is a similar view with the rear flap pivoted open.

In FIG. 5, the rear flap 44 is shown for that purpose in the swiveled-out state, resulting in the opening 12 in the rear portion of the ski boot 1, through which opening the skier wearing the inner boot 10 can put his foot into the ski boot 1. The cover lid 5 is shown in the opened state, and the rotatably supported tension elements 43 are visible. By closing the cover lid 5, the connecting rods 41 are put under tension via lever action by the tension elements 43, so that the rear flap 44 and the shank part are pulled together around the inner boot 10. For this function of tightening the shank part and rear flap together around the inner boot, however, any other familiar system may also be used; a great number of these systems work with a buckle pull, which provides very great variability in circumference.

FIG. 6 shows the section VI—VI of FIG. 4; the pivot shafts 4 and the crossbar 29 of the hoop 15 can be seen. The outrigger 27 is passed through an opening 39 in the shell wall of the foot part 2, and it ends in an actuation knob 28', which can be actuated by hand or conveniently with a ski pole. If the actuation knob 28' is pressed downward, then the detent flap 26 is likewise moved downward and releases the crossbar 29, so that the hoop 15 can return to its relaxed position, moved by the spring 19.

Figure 7:
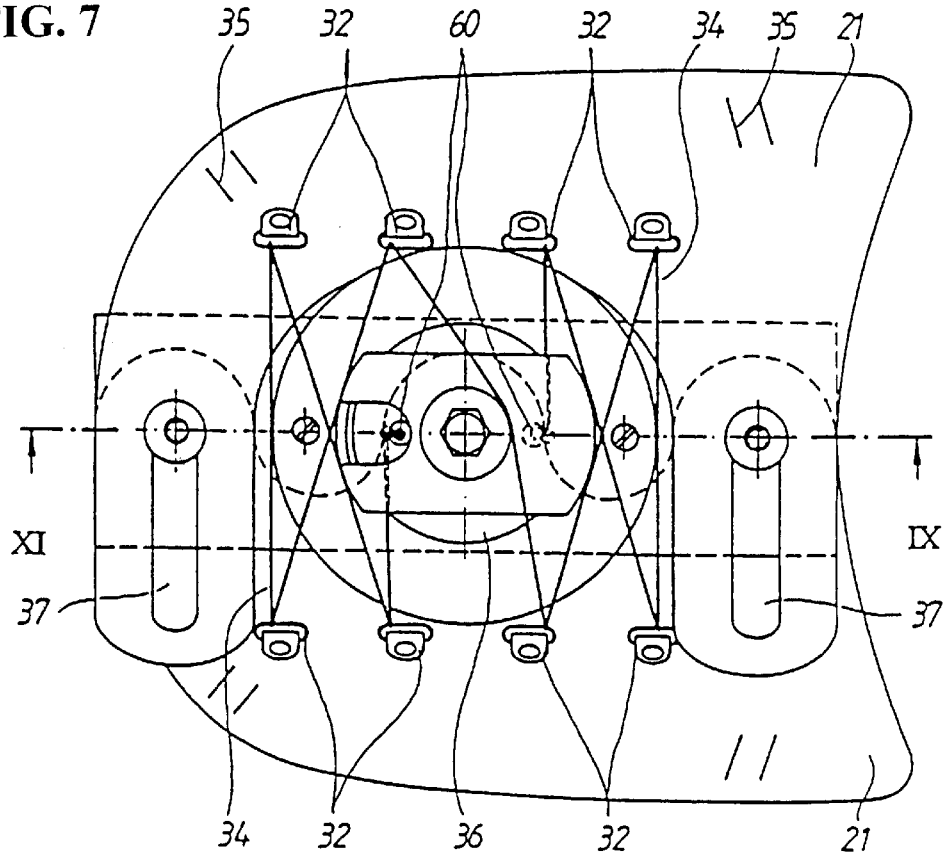
FIG. 7 is a plan view on a portion of a first tensioning system according to the invention.

FIG. 7 shows a part of the first, central variable-tension system 30, which includes two instep covers 21 and a centrally disposed tension disk 36, which by clockwise rotation pulls and tensions a tension cable 34, which is guided like a shoelace through eyelets 32. The instep covers 21, guided in the oblong guide slots 37, are thus pulled toward one another. The first tensioning system 30 adapts itself completely to the shape of the skier's instep via the tension cables 34 and keeps the inner boot 10 inside the outer shell. Via the wire cables 22 passed through notches 35, the first tensioning system 30 is held down against the sole of the outer shell 2, 3 in the downhill position. By this tightening of the second tensioning system 22, the instep covers 21 are pressed against the instep part of the inner boot 10.

Figure 8:
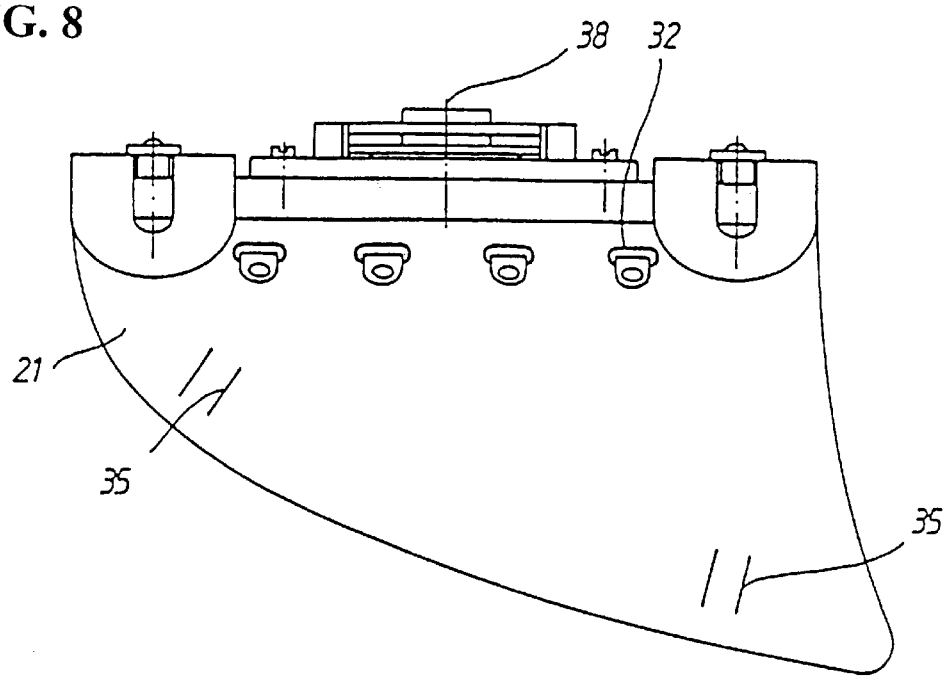
FIG. 8 is a side view of the tensioning system of FIG. 7.

FIG. 8 shows a side view of the instep covers 21 with the pivot shaft 38, suggested by a dash-dotted line, of the tension disk 36. As seen from FIG. 11, this pivot shaft 38 is passed through the shell wall of the foot part 2, and a rotary disk 6 with a hinged wing 61 is disposed on the pivot shaft outside the shell and resting on the shell.

Figure 9:
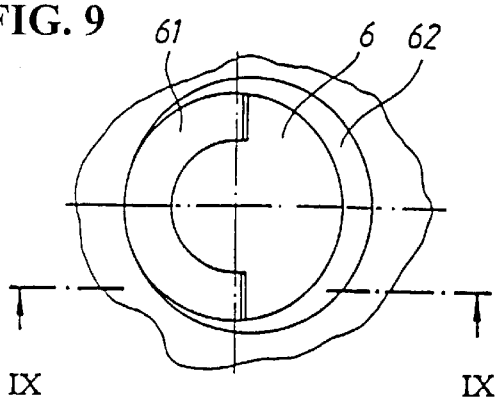
FIG. 9 is a plan view on another part of a first tensioning system according to the invention.
Figure 9A:
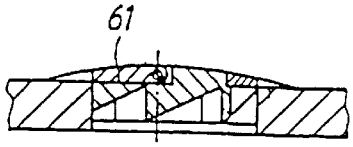
FIG. 9*a* is a section through the part of FIG. 9, taken along the line IX—IX and viewed in the direction of the arrows.
Figure 10:
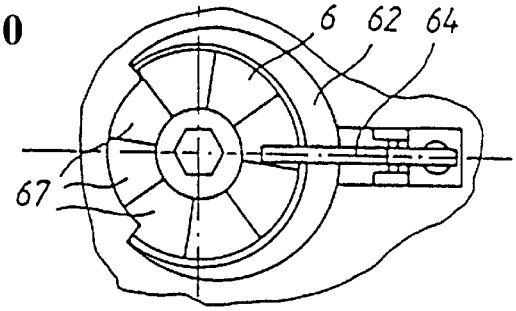
FIG. 10 is a bottom view of the part shown in FIG. 9.
Figure 11:
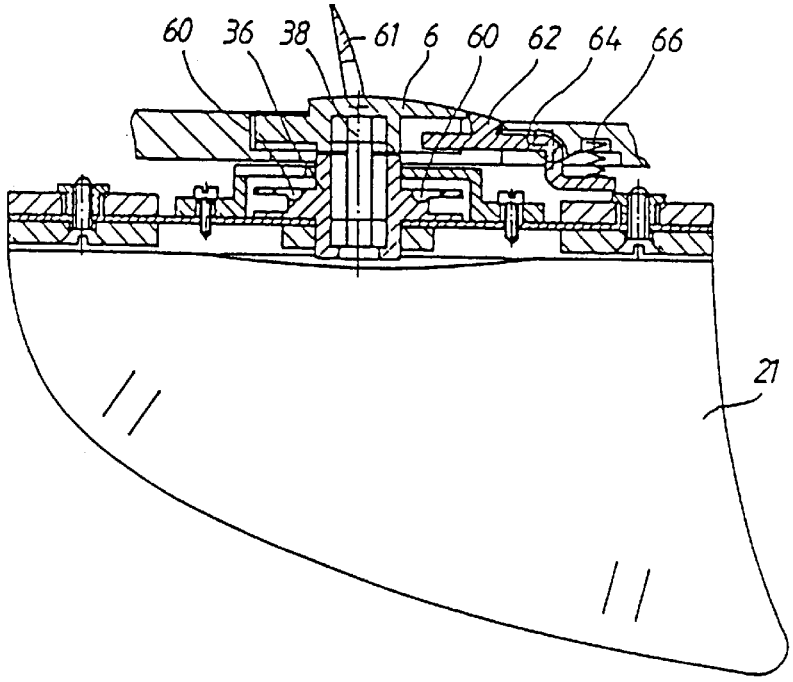
FIG. 11 is a sectional view through the tensioning system taken along the line XI—XI of FIG. 7 and viewed in the direction of the arrows.

FIG. 9 shows a view of the rotary disk 6 with the hinged blade 61 from above. In the cross-section of FIG. 9*a*, the axis is also shown about which the hinged wing 61 can be folded so as to move it from the upright position, in which the rotary disk 6 can easily be rotated with it to actuate the tensioning system, into a flat, lowered position. It can also be seen in FIGS. 9*a*, 10 and 11 that the underside of the rotary disk 6, in an embodiment of the invention, is divided by detent segments 67, which a detent pin 64, resiliently supported via a spring 66 and extending radially to the rotary disk, engages in succession when the tension cable 34 is tightened by rotation of the rotary disk 6. A halfmoon-shaped release pushbutton 62 partly surrounding the rotary disk and guided on the outside is formed onto this detent pin 64 and frees the latched detent pin 64 from its detent position, so that the rotary disk 6 rotates freely as a result of the tension of the tension cable 34 exerted upon it. As a result, a relief of the tension on the foot is provided. The ends of the tension cable are fixed at 60 in such a way that they are not in the way of the rotary motion of the tension disk 36.

Figure 12:
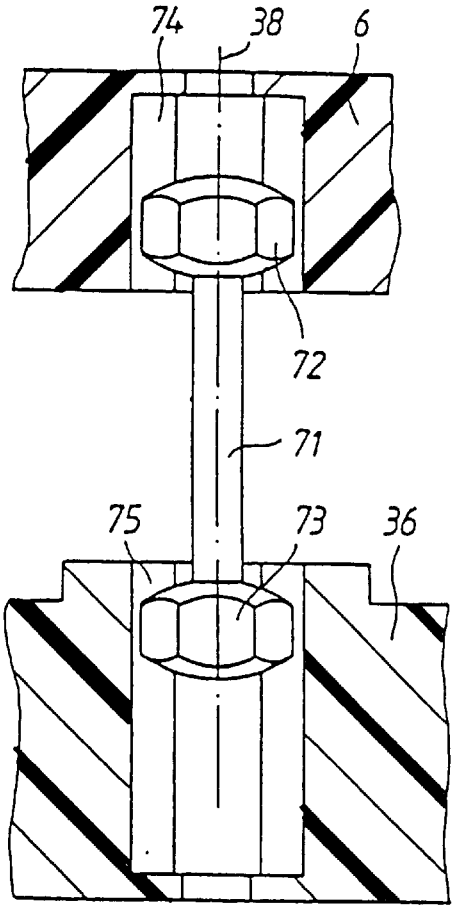
FIG. 12 is a partial section of an embodiment of a first tensioning system.

FIG. 12 shows a variant of the pivot shaft 38 according to the invention, which is formed of a cylindrical middle part 71 that is passed through the shell wall of the foot part 2. On each of its ends, the pivot shaft 38 has a respective polygonal, preferably hexagonal cross-sectional region 72, 73 whose ends are each hemispherically rounded. Both in the center of the rotary disk 6 and in the center of the tension disk 36, there is a respective bearing bush 74, 75 of polygonal, preferably hexagonal, cross section, matching the shape of the end region of the pivot shaft 38. The ends of the pivot shaft 38 engage these bearing bushes 74, 75, with play. As a result, when the rotary disk 6 is rotated, the tension disk 36 can be rotated via the pivot shaft 38; the transmission of force from the rotary disk 6 to the tension disk 36 can be achieved in various relative positions of the pivot shaft 38.

Figure 13:
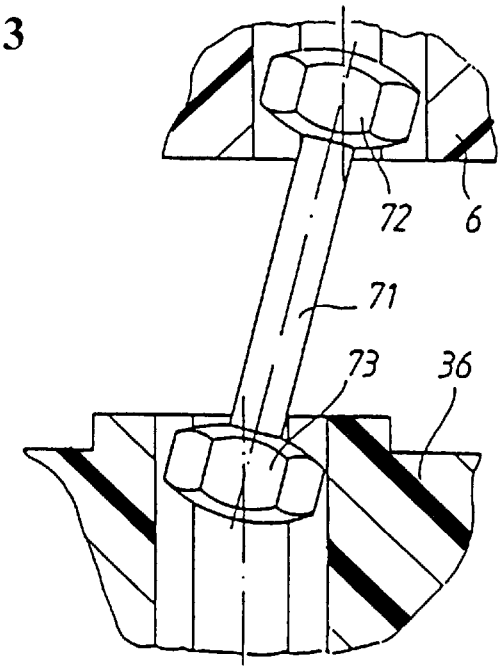
FIG. 13 is a further detail of the partial section illustrated in FIG. 12.

FIG. 13 shows that as a result of the special embodiment of the pivot shaft 38 and pivot bushes 74, 75, the pivot shaft 38 can be placed obliquely, depending on the shape of the instep of the user, or disappears to a variable extent in the bearing bush 74, 75, depending on the size of the instep.

I claim:

1. A ski boot assembly, comprising:

a two-part outer shell including a shank part and a foot part pivotally connected with said shank part; and an inner boot to be received in said two-part outer shell;

pivot means allowing said shank part to be pivoted relative to said foot part between a relaxed position and a latching downhill position;

latching means for locking said shank part in the latching downhill position; said latching means including an actuating device for releasing said shank part from the locked latching downhill position;

a first tensioning system disposed in said outer shell for retaining said inner boot in said outer shell, said first tensioning system being released when said shank part is in the relaxed position; and a second tensioning system disposed in said outer shell for pulling said inner boot downwardly towards a sole of said outer shell when said shank part is pivoted from the relaxed position and locked in the latching downhill position.

2. The assembly according to claim 1, which further comprises a rear flap pivotally connected at a rear of said foot part, said inner boot being insertable into said outer shell via said rear flap.

3. The assembly according to claim 2, including a projection formed on said rear flap and a ledge formed on said inner boot in a region of a heel of a foot, said projection and said ledge interacting for locking said inner boot in said outer shell at the heel.

4. The assembly according to claim 2, including connecting rods for rigidly joining said shank part and said rear flap and a plug closure formed on the rear flap latching said connecting rods.

5. The assembly according to claim 4, including a hinged cover lid pivotally disposed on said rear flap, and including tensioning elements cooperating with said cover lid such that, by lever action, said tensioning elements tense said connecting rods when said hinged cover lid is closed.

6. The assembly according to claim 1, wherein said first tensioning system is a central variable-tension system.

7. The assembly according to claim 1, wherein said inner boot has an instep part, and said second tensioning system holds said inner boot downward against the sole of said outer shell in the downhill position by pressing said first tensioning system against said instep part of said inner boot.

8. The assembly according to claim 1, wherein said shank part has an extension protruding into said foot part, said extension resting in the foot part on a stop in the relaxed position, and said extension latching in a detent in the latching downhill position.

9. The assembly according to claim 1, wherein said second tensioning system includes two wire cables passed from a front portion of said foot part toward a rear portion thereof, in each case guided laterally by said first tensioning system.

10. The assembly according to claim 1, wherein said inner boot is formed as a slipper sock, and said inner boot has a profile embodied on an underside thereof.

11. The assembly according to claim 1, wherein a pivoting of said shank part between the relaxed position and the latching downhill position defines a pivot angle, said pivot angle being approximately 17°.

12. A ski boot assembly, comprising:

a two-part outer shell including a shank part and a foot part pivotally connected with said shank part; and an inner boot to be received in said two-part outer shell;

pivot means allowing said shank part to be pivoted relative to said foot part between a relaxed position and a latching downhill position;

latching means for locking said shank part in the latching downhill position; said latching means including an actuating device for releasing said shank part from the locked latching downhill position;

a first tensioning system disposed in said outer shell for retaining said inner boot in said outer shell, said first tensioning system being released when said shank part is in the relaxed position;

a second tensioning system disposed in said outer shell for holding said inner boot downward against a sole of said outer shell when said shank part is locked in the latching downhill position;

said shank part having an extension protruding into said foot part, said extension resting in the foot part on a stop in the relaxed position, and said extension latching in a detent in the latching downhill position; and wherein said extension of said shank part is an essentially U-shaped hoop extending between said outer shell and said inner boot, having a crossbar, and being joined at its ends to said shank part; wherein said pivot means include a joint formed by two pivot shafts penetrating a wall of said foot part and each penetrating one side part of said hoop, respectively; wherein the relaxed position and the latching downhill position can be selected with a stop and detent position, respectively, of said crossbar of the U-shaped hoop in an interior of said foot part; and wherein said crossbar tenses said second tensioning system in the latching downhill position, such that said first tensioning system is pressed against said instep part of said inner boot.

13. The assembly according to claim 12, which further comprises spring means biasing said crossbar into the relaxed position, and a detent flap for locking said crossbar in the latching downhill position; and wherein said actuating device includes an outrigger with an actuation knob, said outrigger being formed onto said detent flap and extending through the wall of said foot part, said outrigger being means for releasing said crossbar from the latching downhill position.

14. The assembly according to claim 13, wherein said spring means biasing said crossbar into the relaxed position are a helical spring.

15. The assembly according to claim 13, which further comprises a spring holding said detent flap in a detent position.

16. A ski boot assembly, comprising:

a two-part outer shell including a shank part and a foot part pivotally connected with said shank part; and an inner boot to be received in said two-part outer shell;

pivot means allowing said shank part to be pivoted relative to said foot part between a relaxed position and a latching downhill position;

latching means for locking said shank part in the latching downhill position; said latching means including an actuating device for releasing said shank part from the locked latching downhill position;

a first tensioning system in the form of a central variable-tension system disposed in said outer shell for retaining said inner boot in said outer shell, said first tensioning system being released when said shank part is in the relaxed position;

a second tensioning system disposed in said outer shell for holding said inner boot downward against a sole of said outer shell when said shank part is locked in the latching downhill position, wherein said central variable-tension system is formed essentially of two instep covers displaceable parallel to one another transversely to a longitudinal direction defined by said variable-tension system, said instep covers having eyelets disposed thereon longitudinally on each instep cover, and of a lockable tension disk disposed centrally above said instep covers, said tension cable extending like shoelaces through said eyelets and having ends being fixed at opposed circumferential regions of said tension disk; and said wire cables extending through openings formed in two outer sides of said instep covers.

17. The assembly according to claim 16, wherein said tension disk has a pivot shaft extending through a shell wall of said foot part, and including a rotary disk with a hinged wing disposed on said pivot shaft.

18. The assembly according to claim 17, wherein said pivot shaft is formed of a cylindrical middle part and on each of its ends has one polygonal cross-sectional region being rounded hemispherically on each of its ends; and including one bearing bush each of polygonal cross section corresponding to said pivot shaft disposed in a center of said rotary disk and in a center of said tension disk, such that respective ends of said pivot shaft engage each of said bearing bushes with play and such that a force transmission between said rotary disk and said tension disk is possible in various relative positions of said pivot shaft.

19. The assembly according to claim 18, wherein said polygonal cross-sectional region is hexagonal, and said bearing bushes have a hexagonal cross section.

20. The assembly according to claim 17, wherein said rotary disk is divided on an underside thereof by detent segments, and including a resiliently supported detent pin extending radially relative to said rotary disk, said detent segments being engaged in succession by said detent pin when said tension cable is tensed by rotation of said hinged wing, and including a releasing device accessible from an outside of the assembly and being operatively associated with said pin for releasing said pin from the detent position.

21. The assembly according to claim 20, wherein said releasing device is formed by a halfmoon-shaped release pushbutton formed onto said detent pin and partly encompassing said rotary disk.

* * * * *